US005515552A

United States Patent [19]

Tolsma

[11] Patent Number: 5,515,552

[45] Date of Patent: May 14, 1996

[54] FASTENING MECHANISM FOR A TOILET SEAT

[75] Inventor: Hendrik Tolsma, Ijsselmuiden, Netherlands

[73] Assignee: Kleto Holland B.V., Netherlands

[21] Appl. No.: 480,557

[22] Filed: Jun. 7, 1995

Related U.S. Application Data

[63] Continuation of Ser. No. 949,473, filed as PCT/NL91/00065, Apr. 22, 1991, abandoned.

[30] Foreign Application Priority Data

Apr. 23, 1990 [NL] Netherlands ..... 9000961

[51] Int. Cl.[6] ..... A47K 13/12

[52] U.S. Cl. ..... 4/236; 4/240

[58] Field of Search ..... 4/236, 240

[56] References Cited

U.S. PATENT DOCUMENTS

| | | | |
|---|---|---|---|
| 2,431,263 | 11/1947 | Lundgren | 4/236 |
| 3,261,029 | 7/1966 | Beneke | 4/236 |
| 3,608,100 | 9/1971 | Trost | 4/236 |
| 3,670,441 | 6/1972 | Blount | 4/236 |
| 4,404,695 | 9/1983 | Camp | 4/236 X |

FOREIGN PATENT DOCUMENTS

| | | | |
|---|---|---|---|
| 2060019 | 4/1981 | United Kingdom . | |
| 2099496 | 12/1982 | United Kingdom | 4/240 |

*Primary Examiner*—Charles E. Phillips
*Attorney, Agent, or Firm*—Ladas & Parry

[57] ABSTRACT

The invention relates to a fastening mechanism for a toilet seat (2) comprising a bearing block (4) attachable to the toilet bowl (1) with two pivots (12) for the toilet seat which are operable for a movement between the bearing position, in which the toilet seat is borne, and a release position, in which the toilet seat is removable. According to the invention, the bearing block (4) is removable from the toilet bowl (1) in the release position of the pivots.

6 Claims, 1 Drawing Sheet

FASTENING MECHANISM FOR A TOILET SEAT

Figure 1:
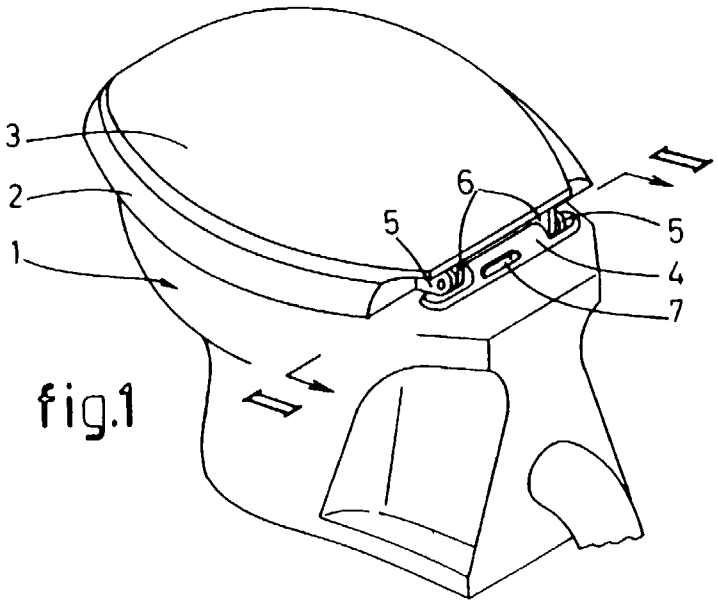

This is a continuation of application Ser. No. 07/949,473 filed on Nov. 5, 1993 now abandoned.

The invention relates to a fastening mechanism for a toilet seat, comprising a bearing block attachable to the toilet bowl with two pivots for the toilet seat, and optionally for a toilet cover, which are operatable for a movement between a bearing position, in which the toilet seat is borne, and a release position, in which the toilet seat is removable.

Such a fastening mechanism is known from U.S. Pat. No. 3,261,029. The bearing block shown therein is screwed onto the toilet bowl by means of bolts. In the bearing block two pivots comprising gear racks are provided, which are movable to and fro by means of a pinion positioned between both gear racks. In the position in which the pivots are closest it is possible to remove the toilet seat and the toilet cover.

Removing the toilet seat and optionally the toilet cover is advantageous with respect to hygienics. As a result it is possible to prohibit any growth of bacteries at the pivot points of the toilet seat and the toilet cover. However, with this known fastening mechanism the problem remains, that dirt may deposit between the toilet bowl and the bearing block, said dirt not or hardly being accessable.

It is an object of the invention to provide a fastening mechanism of the kind referred to above, in which these disadvantages are removed in a very simple, but nevertheless effective way.

Thus the fastening mechanism according to the invention is characterised in that in the release position of the pivots the bearing block is removable from the toilet bowl.

If the pivots have been moved towards the release position by an operation thereof not only the toilet seat, and optionally a toilet cover, may be released from the fastening mechanism, but is it possible to remove the bearing block from the toilet bowl as well. Like this the bearing block itself as well as the contact location between the bearing block and the toilet bowl may be cleaned in an effective way. Thus an extremely hygienic mounting of the toilet seat is obtained, with which undesired dirt deposits and growth of bacteries can be avoided.

According to a preferred embodiment of the fastening mechanism according to the invention locking means are provided which are movable to and fro while operating the pivots and which cooperate with mounting means provided on the toilet bowl.

Due to such a constructive design no additional steps have to been taken for detaching the bearing block from the toilet bowl, because operating the pivots automatically leads to a displacement of the locking means.

In this respect it is advantageous if, in correspondence with another embodiment of the fastening mechanism according to the invention, the locking means are fixed to the pivots. A displacement of the pivots during operation thereof thus automatically leads to a displacement of the locking means.

In the simpliest embodiment the mounting means provided on the toilet bowl can comprise holes provided in the toilet bowl into which the locking means can grip. However, an extremely firm and reliable mounting of the bearing block is obtained, if the mounting means comprise bolts inserted in mounting holes of the toilet bowl, the bolt heads of which are provided with lateral recesses into which the locking means grip in the bearing position. The bolts are not removed from the toilet bowl. However, their dimensions are that small, that they can not or can hardly lead to accumulations of dirt or the like.

If according to another embodiment of the fastening mechanism according to the invention the recesses and the locking means are correspondingly tapered, a reliable cooperation between the locking means and the recesses is constantly obtained.

Further it is possible, that an operating mechanism is applied which is activatable by a removable key. Thus it can be prevented that the toilet seat, the toilet cover or even the fastening mechanism can be taken away by unauthorized persons.

Finally it is preferred that the bearing block is already removable from the toilet bowl before the pivots have fully reached their release position. With such an embodiment an operation firstly releases the bearing block from the toilet bowl without automatically leading to already detaching the bearing block from the toilet seat and optionally from a toilet cover. In such a position it is possible then to entirely remove the fastening mechanism, to which the toilet seat and optionally a toilet cover is still connected, from the toilet bowl. Only after a further operation being carried out the pivots will reach their release position in which the toilet seat, and optionally a toilet cover, are removable from the bearing block.

Hereafter the invention will be elucidated by means of the drawing, in which an embodiment of a fastening mechanism according to the invention is illustrated.

Figure 2:
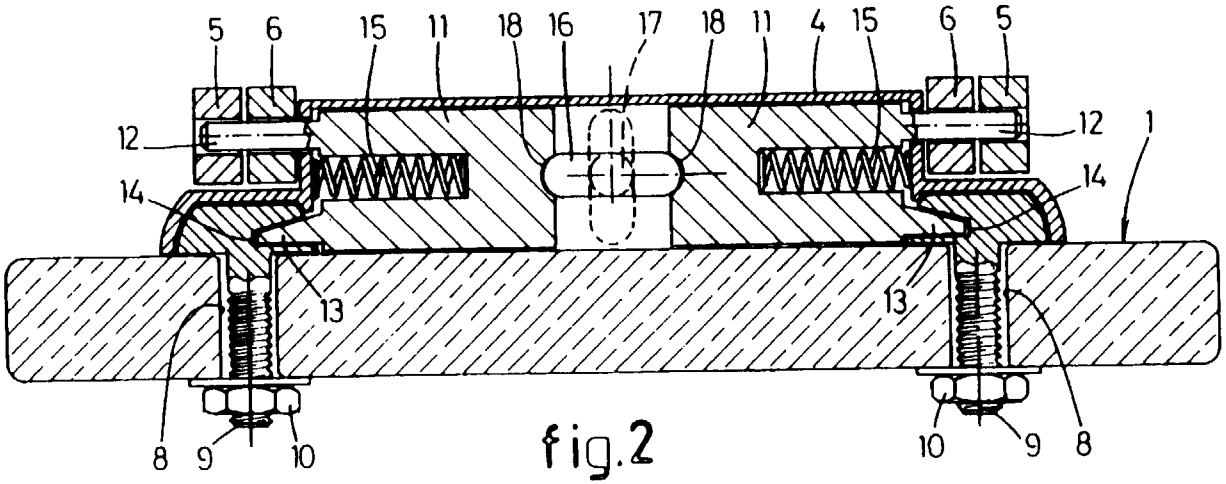

FIG. 1 shows perspectively a toilet bowl, onto which an embodiment of a fastening mechanism according to the invention is applied, and FIG. 2 shows a section through the fastening mechanism according to line II—II in FIG. 1.

FIG. 1 shows a toilet bowl 1 onto which a toilet seat 2 and a toilet cover 3 are mounted. Onto the toilet bowl 1 a bearing block 4 is mounted which bears the toilet seat 2 and the toilet cover 3 through eyes 5 and 6, respectively, connected therewith. Further in FIG. 1 a controle handle 7 is visible, of which the operation will be elucidated by means of FIG. 2.

In the section corresponding to FIG. 2 again a part of the toilet bowl 1 is visible, namely the part onto which the bearing block 4 is provided. In a way known per se mounting holes 8 are provided in the toilet bowl. From the top bolts 9 are inserted into these holes, said bolts at their lower side being secured by nuts 10.

The bearing block 4 is hollow and contains internally two slides 11 slideable to and fro. Each slide 11 carries a bearing pin 12 onto which the eyes 5 and 6 of the toilet seat 2 and the toilet cover 3, respectively, are borne.

The slides 11 further comprise projecting locking means 13 engaging in corresponding recesses 14 of the bolts 9.

Between the wall of the bearing block 4 and the slides 11 spring means 15 are positioned trying to move the slides towards each other. In the position shown such a motion is obstructed by an operating means 16 which can rotate around an axis 17. In a way not shown further this axis 17 carries the handle 7 shown in FIG. 1.

In the position shown in FIG. 2 the ends of the operating means 16 are located into centring recesses 18 in the slides 11. In this position the bearing pins 12 are positioned in a bearing position, in which the eyes 5 and 6 of the toilet seat and the toilet cover are engaged. In this position the locking means 13 further grip into the recesses 14 of the bolts 9. Thus it will be clear that in this position the toilet seat 2 and the toilet cover 3 cannot be removed from the bearing block 4, whereas the bearing block 4 itself neither can be removed from the toilet bowl 1.

If now by operation of the handle 7 the operating means 16 are moved towards the position illustrated in dots in FIG. 2 the slides 11 will be moved inwards under influence of the force applied by the spring means 15, such that the bearing pins 12 to some extent release the eyes 5 and 6. Thus the toilet seat 2 and the toilet cover 3 may be removed. However, simultaneously the locking means 13 leave the recesses 14, such that the bearing block 4 too can be removed from the toilet bowl 1.

Instead of the operating mechanism for the bearing pins 12 and the locking means 13 illustrated in FIG. 2 several different operating mechanisms are imaginable. For example a pinion can be mounted onto axis 17, cooperating with gear racks, which are attached to the slides 11. Further it is possible, that pins are attached to the slides 11 extending through slots provided in the wall of the bearing block 4, said pins being engageable manually for moving the slides 11 to and fro.

In the embodiment according to FIG. 2 the spring means 15 load the slides 11 towards the release position. To avoid that the slides 11 move unintentionally towards this release position the ends of the operating means 16 are located in the centring recesses 18. It is imaginable however, that the spring means 15 are replaced by one single spring means, positioned between both slides 11 and loading these slides 11 towards their bearing position. In such an embodiment by using a correspondingly adapted operating means care should be taken that the slides 11 are moved towards each other against the spring load. It is an advantage of such an embodiment that unintentionally releasing the toilet seat 2, the toilet cover 3 and the bearing block 4, respectively, is less probable.

The locking means 13 have a tapered shape which corresponds with a tapered shape of the recesses 14. As a result a correct centring of the locking means 13 in these recesses 14 occurs and the mounting ease is increased. Further this leads to a certain clamping, such that the bearing block 4 always will be pushed correctly against the toilet bowl 1.

It is conceivable that the operating mechanism is constructed such that the bearing block 4 already can be removed from the toilet bowl 1 before the pivots 12 have fully reached their release position. In FIG. 2 such a configuration can be realized in an easy way by slightly lengthen the bearing pins 12, such that they still hold the eyes 5 and 6 when the locking means 13 already have totally disengaged the recesses 14. Like this it is possible to remove the assembly of bearing block 4, toilet seat 2 and toilet cover 3 in its intirety from the toilet bowl 1. If the bearing pins 12 are lengthened in such a way care should be taken that the slides 11 can realize an inward motion large enough to enable releasing the eyes 5 and 6.

Although in the shown embodiment the locking means 13 engage bolts 9 it is conceivable too, that the locking means 13 engage in a hook-like way into holes 8 provided in the toilet bowl 1. However, preferably specially shaped holes should be applied therefore, which could negatively influence the universal applicability of the fastening mechanism according to the invention.

Finally it is noted, that the operating handle 7 can be of a releasable type, functioning as a key. If the operating handle 7 is removed it is nearly impossible for unauthorised persons to release the bearing block 4 or toilet seat 2, respectively, or toilet cover 3. As a result the fastening mechanism is safeguarded against theft.

The invention is not limited to the embodiment described before, which can be varied widely within the scope of the invention.

I claim:

1. A fastening mechanism for a toilet seat, comprising a bearing block attachable to a toilet bowl by mounting means provided on the toilet bowl, said bearing block housing two pivots for the toilet seat, which pivots are operable for movement between a bearing position, in which the toilet seat is supported on the toilet bowl, and a release position, in which the toilet seat is removable from the toilet bowl, said mechanism including two means for locking said bearing block to said mounting means, each said means for locking being integral with a respective one of the pivots and movable therewith between a first position disposed in engagement with said mounting means when the pivots are in said bearing position and a second position disengaged from said mounting means when the pivots are disposed in said release position so that the bearing block, in the release positions of the pivots, is removable from the toilet bowl.

2. A fastening mechanism according to claim 1, wherein the mounting means comprise bolts inserted in mounting holes of the toilet bowl, said bolts having bolt heads which are provided with lateral recesses adapted to receive and grip the locking means in the bearing position of said pivots.

3. A fastening mechanism according to claim 2, wherein the recesses and the locking means are correspondingly tapered.

4. A fastening mechanism according to claim 1, wherein an operating mechanism is provided for effecting movement of said pivots, said operating mechanism being operable by a releasable handle.

5. A fastening mechanism according to claim 1, wherein the bearing block is already removable from the toilet bowl before the pivots have fully reached their release position.

6. A fastening mechanism according to claim 1, wherein a toilet cover is also supported on the toilet bowl by said pivots for movement between the bearing position and the release position.

* * * * *